US009516966B2

(12) United States Patent
Furusawa et al.

(10) Patent No.: US 9,516,966 B2
(45) Date of Patent: Dec. 13, 2016

(54) SOUND INSULATING CURTAIN

(71) Applicants: Hidekazu Furusawa, Fukuoka (JP); Yasuya Kubota, Torrance, CA (US)

(72) Inventors: Hidekazu Furusawa, Fukuoka (JP); Yasuya Kubota, Torrance, CA (US)

(73) Assignees: Hidekazu Furusawa (JP); TOKYO STEEL IND. CO., LTD (JP)

( * ) Notice: Subject to any disclaimer, the term of this patent is extended or adjusted under 35 U.S.C. 154(b) by 111 days.

(21) Appl. No.: 14/516,119

(22) Filed: Oct. 16, 2014

(65) Prior Publication Data

US 2015/0034415 A1 Feb. 5, 2015

Related U.S. Application Data

(63) Continuation of application No. PCT/JP2013/061395, filed on Apr. 17, 2013.

(30) Foreign Application Priority Data

Apr. 17, 2012 (JP) ..... 2012-093628

(51) Int. Cl.
*A47H 23/08* (2006.01)
*G10K 11/168* (2006.01)

(52) U.S. Cl.
CPC ..... *A47H 23/08* (2013.01); *G10K 11/168* (2013.01)

(58) Field of Classification Search
CPC ..... A47H 23/08
USPC ..... 181/287, 290
See application file for complete search history.

(56) References Cited

FOREIGN PATENT DOCUMENTS

| | | |
|---|---|---|
| JP | 168020/1977 | 12/1977 |
| JP | 3003507 U | 8/1994 |
| JP | 3099094 U | 10/2003 |
| JP | 2008-119156 A | 5/2008 |

OTHER PUBLICATIONS

Translation of JP 52-168020, translated by Phoenix Translations, Mar. 2016.*
International Search Report dated Jun. 25, 2013 for corresponding PCT Application No. PCT/JP2013/061395 (1 page).

* cited by examiner

*Primary Examiner* — Jeremy Luks
(74) *Attorney, Agent, or Firm* — Duquette Law Group, LLC

(57) ABSTRACT

A sound-insulating curtain includes a sound-absorbing core formed by laminating porous sheets and films, is covered by covers, and sewn in an integrated manner. Even after being integrally laminated, adjacently laminated layers are not excessively restrained in places other than sewn areas, and therefore displacement and deformation between layers caused by sound pressure can be tolerated. Sound absorption effects are appropriately produced by each layer, which tolerates such displacement and deformation, while reliably maintaining integrity during handling. Thus, the entire curtain maintains the ability to absorb sounds, efficiently attenuates noise that attempts to pass through the curtain, and suppresses the transmission of noise, thereby enabling noise to be reliably prevented from passing through the curtain.

2 Claims, 2 Drawing Sheets

SOUND INSULATING CURTAIN

RELATED APPLICATIONS

This patent application is a continuation of International Application No. PCT/JP2013/061395, filed on Apr. 17, 2013, now pending, which claims priority to Japanese Application No. 2012-093628, filed Apr. 17, 2012, the contents and teachings of each of which are hereby incorporated by reference in their entirety.

FIELD

The present invention relates to a curtain that decays the transmission of sound, and particularly to a curtain having a structure in which a plurality of sheet-shaped members having sound-absorbing property is combined into a combined body.

BACKGROUND

In an indoor space of a room in a common building or a house, curtains have been used widely for the purpose of light shielding at a window or partition of a room space. Of such curtains, specifically, curtains having an improved sound-insulating property have conventionally been proposed in order to prevent an external noise from coming into a room space through a window, or an unwanted external sound from coming into an area divided by a partition. JP 3099094 U (Reference 1) and JP 2008-119156 A (Reference 2) disclose an example of such a conventional curtain having a sound-insulating property.

In addition to this, concerning a specific example of a room space, in a hospital room with multiple beds in a hospital in which a plurality of inpatients stays, areas for patients using the respective beds are partitioned with curtains so as to provide a blind sheet to protect tentatively their privacy.

SUMMARY

Technical Problem

The conventional curtain is disclosed in the patent literatures as indicated above. However, adequate measures to prevent a noise from coming into a room space, etc. could not be taken by merely providing a curtain.

For example, Reference 1 as indicated above includes a problem that, although a cloth of woven fabric or knit fabric is used as material for the curtain on the opposite surfaces of the curtain, the cloth portions are adhesively bonded together. As a result, even when a sound pressure is applied, they cannot move freely and a sound-absorbing effect such as a porous material type sound-absorbing effect or a panel vibration (a membrane vibration) type sound-absorbing effect cannot be appropriately achieved. Thus, the curtain of Reference 1 does not control the transmission of sound.

Reference 2 as indicated above includes a problem that a portion of a sound-insulating member, which is held between surface sections, is placed in a restraint condition due to the bonding process. Accordingly, a sound-absorbing effect is degraded. Additionally, a sound-absorbing member is held by the bonding of surface sections and the sound-insulating member, which results in an area with no sound-absorbing member between the surface sections, thus degrading a whole controlling effect of the transmitting sound by a degraded amount of the sound-absorbing effect in such an area with no sound-absorbing member.

In case where the room space as indicated above is in a hospital room with multiple beds, the curtain used as a partition in the hospital room provides an appropriate function as a blind sheet. Such a curtain has a light shielding property. However, there has not specifically been made consideration of control of sound transmission, thus causing a state in which a sound emitted at an area of a certain patient could reach ears of another patient.

Such a curtain could not fully decay not only a noise from an inside of the hospital room, but also a noise from an outside of the hospital room, and the noise could reach the patient. The patients have been more dissatisfied with a sound environment, and there have been sought improvements in a sound-insulating property from a viewpoint of protection of privacy and the ensuring of a quiet environment.

For these reasons, it is conceivable to apply a conventional curtain having a sound-insulating property in view of control of the noise. However, such a kind of curtain has a problem that a sound-absorbing member-disposed section having a certain thickness to provide a sufficient sound-absorbing property is hard and lacks flexibility, resulting in difficulty in using it as a curtain, which is flexible and has the same usability as the conventional curtain.

In addition, there is a problem that, in view of use in a hospital room, it is difficult to apply, as a curtain for partition, in which functions of flameproof, antibacterial activity, etc., are required, the conventional sound-insulating curtain provided on the outermost side with a sound-absorbing member having a large surface area.

An object of the present invention, which has been made to solve the above-described problems, is to provide a sound-insulating curtain, which has a structure that a porous sheet member and the other member are combined into a combined body, and has a sufficient flexibility as a curtain and an excellent usability as a curtain, and has an excellent sound absorbing property to ensure a sound-insulating performance through the curtain, and permits to prevent an unwanted sound from reaching.

Solution to Problem

Embodiments of the innovation relate to a sound-insulating curtain which is to be provided as a partition so as to be capable of spreading between two areas. The sound-insulating curtain comprises: a sound-absorbing core, which is formed by conducting a plurality of steps of placing a porous sheet member having at least flexibility, compressive deformability and restorability against deformation, and a smooth film formed of synthetic resin; a cover member, which is formed of a sound-transmitting flexible material and is almost sheet-shaped, wherein: a combined body in which the sound-absorbing core and the cover members are placed so that the sound-absorbing core is held between the cover members on opposite sides of the combined body, is continuously sewn in a vertical direction in a hanged state, and a plurality of rows of sewn section by sewing is provided at predetermined intervals in a horizontal direction, so as to form a combined body into a whole.

According to the present invention, the sound-absorbing core in which the porous sheet member and the film are combined is covered with the cover members, and they are sewn to form the combined body, and the respective adjacent layers as combined are not put in an excessive restraint condition at the other area than the sewing sections, even after applying the combining step to the combined layers. This structure enables the respective layers to be displaced and deformed due to pressure of the sound, and permits to surely maintain the combined state in use, and provide the respective sound-absorbing effects in these layers, which can be displaced and deformed, to ensure the absorbing performance of the sound in the whole curtain and to decay effectively the noise, which is apt to transmit through the curtain, thus surely preventing the sound from transmitting through the curtain to reach an area through the curtain.

The porous sheet member is disposed, with uniformity, anywhere including the sewing sections so as not to provide any area in which the porous sheet member is not disposed, thus preventing degradation of the local sound-absorbing performance. In addition, the members each having flexibility are combined and sewn at the minimum necessary portion into a combined body to provide the curtain, thus making it possible to maintain flexibility in the whole curtain, cause a user to easily cope with the handling as the curtain with portions, which are bendable and extensible, and provide the same usability as the common curtain without requiring a specific attention of the user.

In the sound-insulating curtain according to the present invention, the porous sheet member may comprise a non-woven fabric having a small contact area with the film.

According to the present invention including such a feature, in a boundary area between the non-woven fabric as the porous sheet member and the film, there is a point contact with the film in any position, to provide an extremely decreased area of the contact area, and the non-woven fabric having the small frictional resistance as reduced with the film becomes slippery to the film so as to permit the non-woven fabric and the film to slide each other, thus easily causing their displacement and deformation. This makes it possible to provide sufficiently a porous material type sound-absorbing effect by the non-woven fabric or a panel vibration type sound-absorbing effect by the film, so as to decay surely the sound, which is apt to transmit through the curtain, thus preventing the sound from reaching the area within the inside of the curtain.

DETAILED DESCRIPTION

Figure 1:
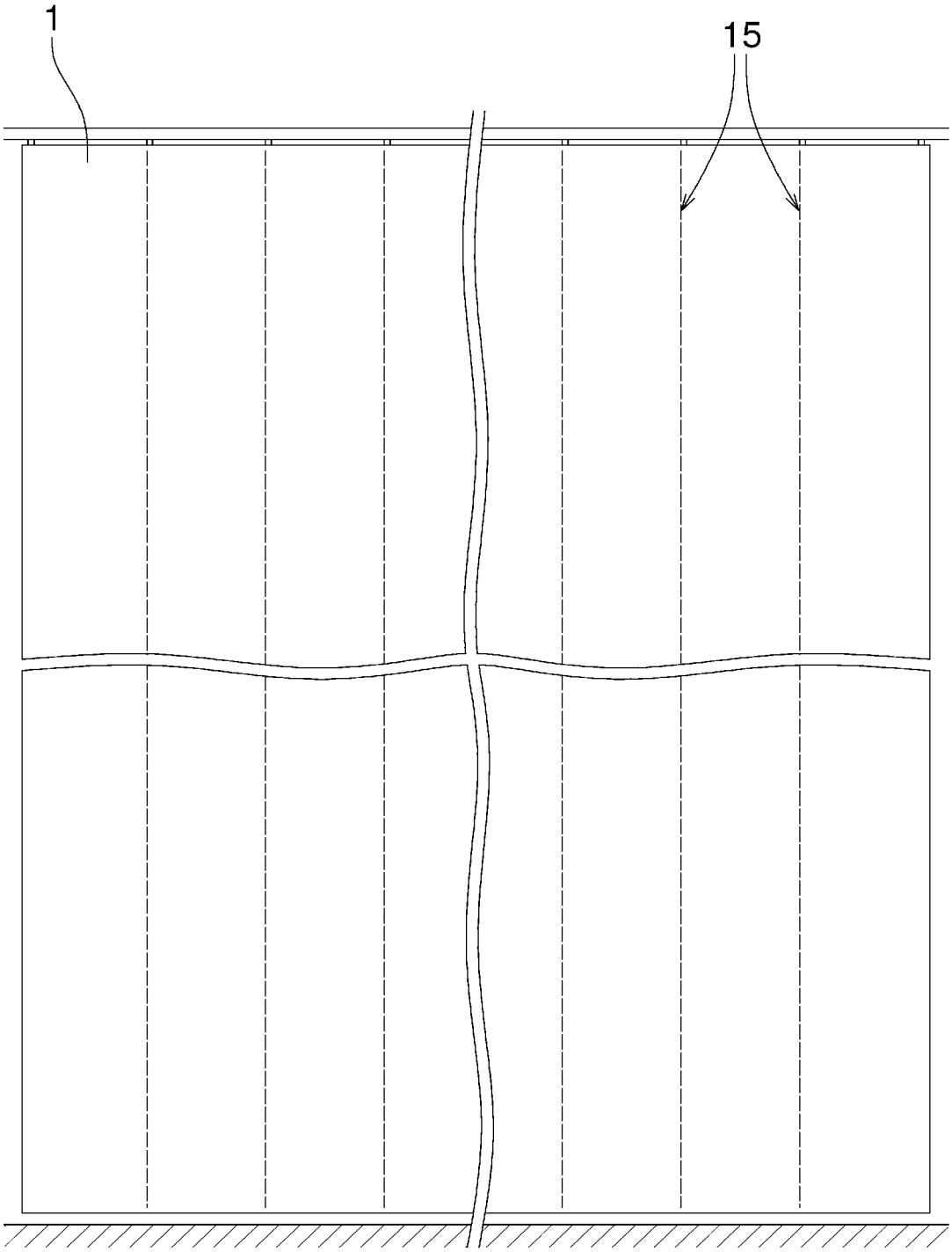
FIG. 1 is a schematic structural view in a closed state of the sound-insulating curtain according to one embodiment of the present invention.
Figure 2:
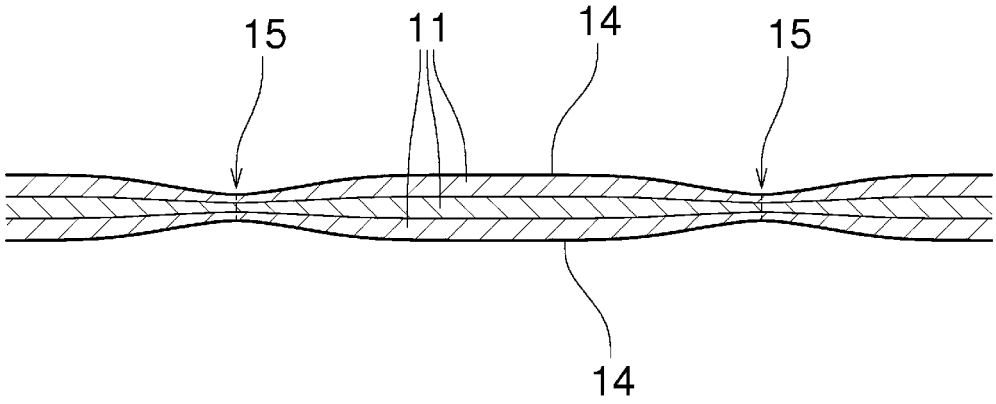
FIG. 2 is an enlarged cross-sectional view of an essential portion in a closed state of the sound-insulating curtain according to one embodiment of the present invention.
Figure 3:
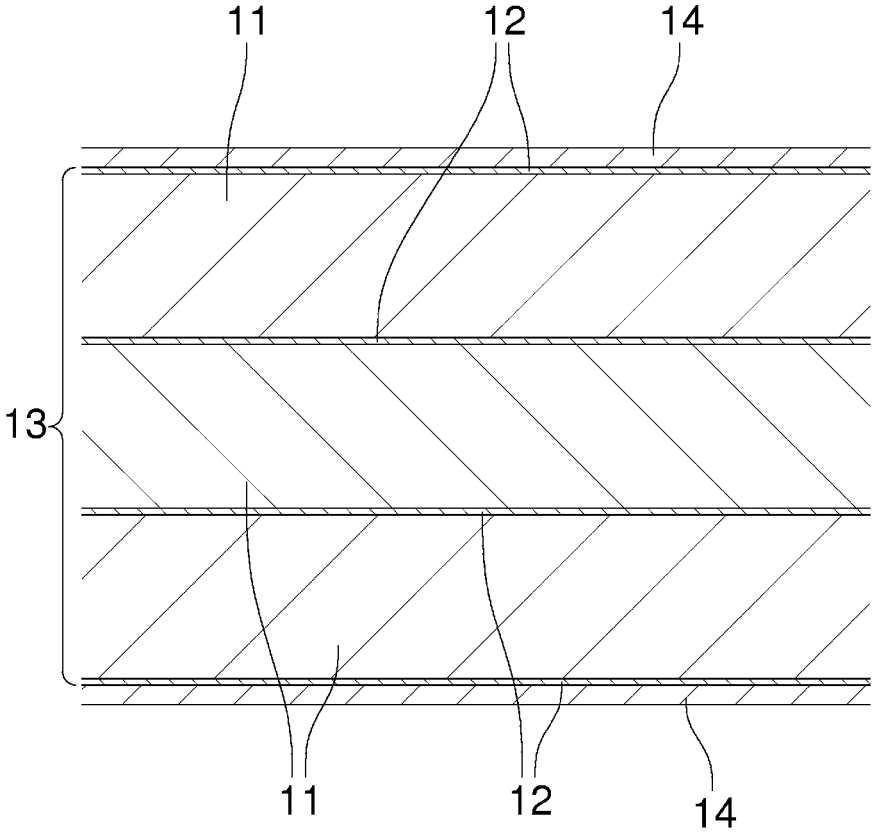
FIG. 3 is a descriptive view in a combined state of the respective members of the sound-insulating curtain according to one embodiment of the present invention.

Now, a sound-insulating curtain according to one embodiment of the present invention will be described below with reference to FIGS. 1 to 3 as indicated above.

In each of the figures as indicated above, the sound-insulating curtain 1, according to the present invention, is provided with a sound-absorbing core 13. The sound-absorbing core 13 is formed by placing a non-woven fabric 11, serving as a porous sheet member having a sound-absorbing property, on a smooth film 12 formed of synthetic resin, and with a cover member 14, which is placed on this sound-absorbing core 13 and formed of a sound-transmitting material and is almost sheet-shaped.

The above-mentioned non-woven fabric 11 is a known flexible porous member, which has been prepared by collecting and combining natural fiber and synthetic fiber together into a sheet, and also has an elastic deformability by which it can be compressed and restored in a thickness direction.

The non-woven fabric 11 of which the porous sheet member is formed may cause friction between the fiber materials within the fabric during deformation, so as to absorb an external energy by which the deformation is caused, i.e., a sound.

The thickness of the non-woven fabric 11 is set, for example, as several millimeters. However, the present invention is not limited only to it, and there may appropriately be selected a thickness suitable for the material and the use as the sound-absorbing material. It is necessary to use the same structure in each of the layers of which the sound-absorbing core 13 is formed in a combined state, and there may be applied a multiple structure in which the respective layers have different characteristic properties such as density, etc. so as to widen a frequency band of the sound, which may be absorbed by the respective layers of non-woven fabric.

The above-described film 12 is flexible and extremely thin, and has the same area as the non-woven fabric 11 and the smooth surface. The thickness of the film 12 is set as a negligible small value relative to the thickness of the non-woven fabric 11 serving as the porous sheet member, for example as 0.1 mm. However, the present invention is not limited only to it, and there may appropriately be selected a thickness suitable for the material and the use as the sound-absorbing material.

The sound-absorbing core 13 is formed by placing this film 12 on the non-woven fabric 11. The sound-absorbing core 13 has a structure, which may provide a weight and flexibility applicable to be used comfortably as a curtain, while improving the sound-absorbing effect. For example, the sound-absorbing core 13 has a structure in which the film 12 has a four-layer structure in which the non-woven fabric 11 is placed between the adjacent layers of the film, and the non-woven fabric 11 has a three-layer structure.

The above-described cover member 14 is a thin sheet formed of a cloth having a flameproof property, and has a sound-transmitting property and flexibility, and covers the surface of the sound-absorbing core 13 to protect it.

This cover member 14 and the sound-absorbing core 13 are placed one on the other to form a combined body so that the sound-absorbing core 13 is held between the cover members on the opposite sides, and such a combined body is sewn into a combined body to prepare a curtain 1.

The curtain 1 has a structure in which the sound-absorbing core 13 is included between the cover members 14. The curtain 1 is placed around an object person on the side of which a noise is to be prevented from coming. The noise transmitting toward the object person reaches the curtain 1 to be decayed through the sound-absorbing effect of the non-woven fabric 11 and the film 12, thus preventing effectively the noise from reaching the object person 80.

Now, a method for manufacturing the sound-insulating curtain according to the present invention will be described. First, the non-woven fabrics 11 as the porous sheet member are placed one on the other so that the film 12 is held between the adjacent non-woven fabrics. After there is prepared the sound-absorbing core 13 in which the non-woven fabrics 11 and the films 12 are placed one on the other by the respective set numbers of them, the cover members 14 are placed on the both surfaces of this sound-absorbing core 13.

The combined body in which the sound-absorbing core 13 is placed between the cover members 14, is continuously sewn in a vertical direction in a hanged state of the curtain, and a plurality of rows of sewn section 15 by sewing is provided at predetermined intervals in a horizontal direction, so as to form a combined body into a whole, thus preparing the curtain 1.

The distance between the rows of sewn section 15 in the horizontal direction of the curtain, i.e., the distance between the sewing lines is preferably set as a value by which an external appearance of the curtain as folded by an equal interval may be kept in the same manner as the common curtain, and for example as 15 cm. With larger distance than this value, the portions of the curtain which is to be folded may not be formed regularly, resulting in causing improper creases of the curtain as folded, which are misaligned to each other in the vertical direction, thus causing disfigurement of the curtain.

By conducting the sewing step, the cover members 14 and the sound-absorbing core 13, which are placed one on the other, but each have a small friction coefficient and are slippery, are easily kept in a state in which they cannot be separated from each other. In an area excluding the sewn sections of the curtain 1, each of the non-woven fabrics 11 between which the film 12 is held is placed in a non-compressed state, to contain air to maintain substantially the original thickness of it. In the sewing step, there may be formed pleats, which facilitate the natural bending of the curtain in the hanged state, in order to improve usability when opening and closing the curtain.

Next, description will be given of use of the sound-insulating curtain according to the present invention. The curtain 1 is placed in the hanged state around an object person who wishes to prevent the noise from coming, in a room space, so that, when the curtain is spread to close it, the curtain exists between the noise source and the object person to insulate the object person from the noise source. The non-woven fabric 11, which is not robust, is combined to the other member and its surface is covered with the cover member 14, thus making it possible to place easily the curtain without causing any problem of the handling.

In a state in which this curtain 1 is placed, the noise from the noise source spreads and propagates in every directions and the sound, which has come straight from the noise source or reflected once from a ceiling or wall and then directed toward the object person in the room space, reaches the curtain 1.

When the sound reaches the curtain 1, most of the sound passes through the cover member 14. The sound, which has passed through the cover member 14, reaches the non-woven fabric 11 inside the cover member, and a part of the sound is absorbed by the porous non-woven fabric 11. Then the sound, which has passed through the non-woven fabric 11, reaches the film 12.

In the sewn section 15 of the non-woven fabric 11 and the film 12, the non-woven fabric 11 is compressed and deformed, thus being in a high restraint state and deteriorated in a sound-absorbing performance in comparison with the other portion. However, the sound may be decayed through the porous material type sound-absorbing effect, so as to prevent the sound from transmitting.

In the film 12, there is caused absorption of the sound mainly through the panel vibration type sound-absorbing effect, thus decaying the sound here. In a boundary area between the non-woven fabric 11 and the film 12, the frictional resistance of the non-woven fabric 11 to the film 12 is small and the non-woven fabric 11 and the film 12 become slippery to each other, so as to easily cause their displacement and deformation, thus ensuring a state in which there may be provided sufficiently the porous material type sound absorbing effect and the panel vibration type sound-absorbing effect.

Every time the sound reaches the non-woven fabric 11 or the film 12, the sound may be decayed through the respective sound-absorbing effects, and finally, on the side of the cover member 14, which is placed on the rear side of the curtain and opposite to the side on which the sound has been incident, there is no transmission of the sound or a small level of transmitting sound, which may not be perceived as the noise, propagates toward the object person in the inside of the curtain 1.

This makes it possible to decay effectively an energy of the noise, which is apt to propagate from the outside area of the curtain to the inside area of the curtain, to prevent the noise from reaching the object person, and reduce the discomfort of the noise, thus improving remarkably the quality of environment of the sound in the room space.

The cover member 14 has a flameproof property imparted to it. Accordingly, in use of the curtain 1 in the room space, even if the curtain is mistakenly put close to fire, it is unlikely to result in a problem that the fire spreads to the curtain 1. Accordingly, use of the curtain 1 results in a minimal risk of fire, which results in the curtain 1 being used without any problems in the room space, for example in a hospital room in which a specific consideration of safety is required.

In the sound-insulating curtain according to the present invention, the sound-absorbing core 13 in which the non-woven fabrics 11 and the films 12 are combined is covered with the cover members 14, and they are sewn to form the combined body, and the respective adjacent layers as combined are not put in an excessive restraint condition at the other area than the sewing sections, even after applying the combining step to the combined layers. This structure enables the respective layers to be displaced and deformed due to pressure of the sound, and permits to surely maintain the combined state in use, and provide the respective sound-absorbing effects in these layers, which can be displaced and deformed, to ensure the absorbing performance of the sound in the whole curtain and to decay effectively the noise, which is apt to transmit through the curtain, thus surely preventing the sound from transmitting through the curtain to reach an area through the curtain.

The non-woven fabric 11 is disposed, with uniformity, anywhere including the sewing sections so as not to provide any area in which the non-woven fabric 11 is not disposed, thus preventing degradation of the local sound-absorbing performance. In addition, the members each having flexibility are combined and sewn at the minimum necessary portion into a combined body to provide the curtain, thus making it possible to maintain flexibility in the whole curtain, cause a user to easily cope with the handling as the curtain with portions, which are bendable and extensible, and provide the same usability as the common curtain without requiring a specific attention of the user.

Example

The sound-insulating curtain of the present invention was actually used in a hanged state and there was made a measurement assessment on a level of transmission of the sound from the sound source. The results were described below.

More specifically, the sound-insulating curtain of the present invention was placed in a hanged state in a room space for experiment, the sound (e.g., pink noise) was output from a speaker, a sound pressure level of the sound transmitting through the curtain in a spread and closed state of it was measured in an area, which was apart from the speaker and separated by the curtain in the same room space, and there were measured, as measurement values, an average value and the maximum peak value of the sound pressure level within a measuring time (e.g., 30 seconds).

The measurements were made in the same manner in case where the sound-insulating curtain of the present invention was used (Example No. 1 of the present invention), in case where the curtain was folded together in an opened state, the sound from the speaker directly reached a measurement device without transmitting through the curtain (Comparative Example No. 1), and in case where there was applied the combined structure in which only the non-woven fabrics were used in the sound-absorbing core of the structural components of the present invention, without providing the film (Comparative Example No. 2).

For the sound-insulating curtain of the present invention, the film of polyvinyl chloride was used, and the curtain containing the non-woven fabrics and the cover members had the maximum thickness of 20 mm at the other area than the sewn section. Comparative Example No. 2 as indicated above had a structure in which the films were excluded from the sound-insulating curtain of the present invention. In each of the cases of Example No. 1 of the present invention and Comparative Example No. 2, the curtain was placed so that it was fully spread and the sound from the speaker was incident at right angles on substantially the flat surface of the curtain, and the sound from the speaker was not directly measured. In addition, the curtain had an appropriate length in the vertical direction extending from the upper side to the lower side in the room space, so as to prevent the sound from coming from the upper and lower sides of the curtain.

Table 1 shows the measurement values of the sound pressure level at places, which were away from the speaker by the same distance, when the sound was output from the speaker in the same manner in Example No. 1 of the present invention and the respective comparative examples. However, the room space as the measurement environment was not completely silence and had not a complete sound-insulating structure, and background noise existed.

| | Average Value (dB) | Peak Value (dB) |
|---|---|---|
| Example No. 1 of the Present Invention | 71.2 | 78.5 |
| Comparative Example No. 1 | 80.7 | 88.5 |
| Comparative Example No. 2 | 75.4 | 83.2 |

Table 1 as indicated above shows that the level of the transmitting sound in any one of the average value and the peak value in Example No. 1 of the present invention was more effectively lower than the respective comparative examples. Especially, even in comparison with Comparative Example No. 2 in which the films were excluded from the structure of the curtain of the present invention, the transmitting sound was decayed in Example No. 1 of the present invention. It is clearly recognized that the panel vibration type sound-absorbing effect of the film was additionally achieved not only by providing the sound-absorbing effect by the non-woven fabric in the combined body, but also by using the film between the non-woven fabrics, and that the non-woven fabric slid on the film in a contact state to facilitate displacement and deformation, thus clearly revealing achievement of the porous type sound-absorbing effect by the non-woven fabric.

It is thus clearly recognized that the sound-insulating curtain of the present invention, which is placed in a hanged state between the sound source and the area in which the sound from the sound source is to be prevented from coming, can achieve an appropriate sound insulation by the sound absorbing effects in the respective components of the curtain, so as to prevent the sound from transmitting into the area on the rear side of the curtain, thus ensuring a state in which the noise, etc. may not easily transmit through the curtain.

REFERENCE SIGNS LIST

1 curtain
11 non-woven fabric
12 film
13 sound-absorbing core
14 cover member
15 sewn section

What is claimed is:

1. A sound-insulating curtain, which is to be provided as a partition so as to be capable of spreading between two areas, said sound-insulating curtain comprising:

a sound-absorbing core, which is formed by conducting a plurality of steps of placing a porous sheet member having at least flexibility, compressive deformability and restorability against deformation, on a smooth film formed of synthetic resin, a boundary area between the porous sheet member and the smooth film having a frictional resistance configured to allow the porous sheet member and the smooth film to slide relative to each other; and cover members, which are formed of a sound-transmitting flexible material and are almost sheet-shaped, wherein:

a combined body in which said sound-absorbing core and said cover members are placed so that the sound-absorbing core is held between the cover members on opposite sides of the combined body, is continuously sewn in a vertical direction in a hanged state, and a plurality of rows of sewn section by sewing is provided at predetermined intervals in a horizontal direction, so as to form a combined body into a whole.

2. The sound-insulating curtain, as claimed in claim 1, wherein:

said porous sheet member comprises a non-woven fabric having a small contact area with said film.

* * * * *